US006561922B2

(12) United States Patent
Bamber

(10) Patent No.: US 6,561,922 B2
(45) **Date of Patent: *May 13, 2003**

(54) GOLF CLUB SHAFT

(76) Inventor: Jeffrey Vincent Bamber, 5023 Village Dr., Cincinnati, OH (US) 45244

( * ) Notice: Subject to any disclaimer, the term of this patent is extended or adjusted under 35 U.S.C. 154(b) by 0 days.

This patent is subject to a terminal disclaimer.

(21) Appl. No.: 09/957,315

(22) Filed: Sep. 20, 2001

(65) Prior Publication Data

US 2002/0016215 A1 Feb. 7, 2002

Related U.S. Application Data

(60) Division of application No. 09/336,790, filed on Jun. 21, 1999, which is a continuation of application No. 08/730,226, filed on Oct. 15, 1996, now Pat. No. 5,913,733, which is a continuation-in-part of application No. 08/567,808, filed on Dec. 6, 1995, now abandoned, which is a continuation of application No. 08/236,351, filed on Apr. 29, 1994, now abandoned, which is a continuation-in-part of application No. 07/999,094, filed on Dec. 31, 1992, now Pat. No. 5,335,908.

(51) Int. Cl.[7] ..... A63B 53/10

(52) U.S. Cl. ..... 473/317; 473/318; 473/327

(58) Field of Search ..... 473/316, 317, 473/318, 319, 320, 321, 322, 323, 219, 131, 289, 282, 228, 231, 232, 233, 327

(56) References Cited

U.S. PATENT DOCUMENTS

| | | | |
|---|---|---|---|
| 1,239,356 | A | 9/1917 | Cochrane et al. |
| 1,396,470 | A | 11/1921 | Taylor |
| 1,528,017 | A | 3/1925 | Gammeter |
| 1,615,232 | A | 1/1927 | Pryde et al. |
| 1,787,415 | A | 12/1930 | Washington |
| 1,890,037 | A | 12/1932 | Johnson |
| 1,890,538 | A | 12/1932 | Hadden |

(List continued on next page.)

FOREIGN PATENT DOCUMENTS

| | | |
|---|---|---|
| GB | 13712 | 7/1905 |
| GB | 327720 | 4/1930 |
| GB | 354416 | 8/1931 |
| GB | 434533 | 9/1935 |
| GB | 489638 | 10/1936 |
| GB | 518699 | 3/1940 |
| GB | 1391768 | 4/1975 |

OTHER PUBLICATIONS

"The Snake Eyes Have It", Golf World magazine, Mar. 11, 1994, p. 12, The Golf Digest Companies, Trumbull, CT, USA.

(List continued on next page.)

*Primary Examiner*—Sebastiano Passaniti
(74) *Attorney, Agent, or Firm*—Jeffrey V. Bamber

(57) ABSTRACT

An improved aerodynamic golf club shaft is disclosed. The improved aerodynamic golf club shaft comprises a tube that has an exterior with a non-circular cross section. The golf club shaft may have an elliptical exterior cross section in one preferred embodiment. The golf club shaft has a leading edge that is on the half of the shaft aligned with the face of the golf club and a trailing edge on the half of the shaft aligned with the back of the club. A portion of the leading edge of the shaft has a smaller radius of curvature than the leading edge of a equivalently sized shaft having a circular cross section.

8 Claims, 4 Drawing Sheets

U.S. PATENT DOCUMENTS

| | | | | |
|---|---|---|---|---|
| 1,917,795 | A | | 7/1933 | Fetter |
| 1,932,902 | A | | 10/1933 | McDowell |
| 1,950,342 | A | | 3/1934 | Meshel |
| 1,994,069 | A | | 3/1935 | Fletcher |
| 1,994,194 | A | | 3/1935 | Root |
| 2,001,643 | A | | 5/1935 | Wilcox |
| 2,018,723 | A | | 10/1935 | Hutchinson |
| 2,027,635 | A | | 1/1936 | Cunningham |
| 2,088,095 | A | | 7/1937 | Sargent et al. |
| 2,146,321 | A | | 2/1939 | Wettlaufer |
| 2,150,737 | A | | 3/1939 | Chittick |
| 2,153,550 | A | | 4/1939 | Cowdery |
| 2,169,774 | A | | 8/1939 | Taylor |
| 3,083,969 | A | | 4/1963 | Bills, Jr. |
| 3,848,737 | A | | 11/1974 | Kenon |
| 4,023,801 | A | | 5/1977 | Vanauken |
| 4,188,032 | A | * | 2/1980 | Yangioka |
| 4,288,075 | A | | 9/1981 | Kaugars et al. |
| 4,597,577 | A | | 7/1986 | Lamanna |
| 4,629,191 | A | | 12/1986 | Mancuso |
| 4,809,983 | A | | 3/1989 | Langert |
| 4,836,545 | A | | 6/1989 | Pompa |
| 4,943,059 | A | | 7/1990 | Morell |
| 4,958,834 | A | | 9/1990 | Colbert |
| 5,040,279 | A | | 8/1991 | Braly |
| 5,067,711 | A | | 11/1991 | Parente et al. |
| 5,094,454 | A | | 3/1992 | Schering |
| 5,120,061 | A | | 6/1992 | Tsuchida |
| 5,158,289 | A | * | 10/1992 | Okumoto |
| 5,165,688 | A | | 11/1992 | Schmidt et al. |
| 5,190,289 | A | | 3/1993 | Nagai et al. |
| 5,230,510 | A | | 7/1993 | Duclos |
| 5,253,867 | A | | 10/1993 | Gafner |
| 5,316,300 | A | | 5/1994 | Simmons |
| 5,335,908 | A | | 8/1994 | Bamber |
| 5,354,056 | A | | 10/1994 | Cornish, III |
| 5,395,109 | A | | 3/1995 | Fenton, Jr. |
| 5,429,355 | A | | 7/1995 | Schmidt et al. |
| 5,511,780 | A | | 4/1996 | Vadersen |
| 5,540,435 | A | | 7/1996 | Kawaski |
| 5,545,094 | A | | 8/1996 | Hsu |
| 5,575,723 | A | | 11/1996 | Take et al. |
| 5,575,725 | A | | 11/1996 | Olsavsky |
| 5,913,733 | A | | 6/1999 | Bamber |

OTHER PUBLICATIONS

Jeffrey B. Ellis, "The Clubmaker's Art", Shafts, pp. 494–525, Zyphyr Productions, Inc., Oak Harbor, Washington, USA.

Harrison Sports, Inc., Harrison "The Longest Driving Shafts" advertisement, Golf World magazine, Jun. 8, 2001, p. 97, The Golf Digest Companies, Trumbull, CT, USA.

True Temper, BiMatrix shaft advertisement, Golf World magazine, Jun. 22, 2001, p. 31, The Golf Digest Companies, Trumbull, CT, USA.

Adams Golf, "Introducing the Multi–Material Shaft Advantage", Tight Lies advertisement showing BiMatrix shaft, Golf Magazine, Jun. 2001, pp. 25–28, Time4 Media, Inc., NY, NY, USA (refers to BiMatrix shaft being patented).

Scott Hennessy, The Experts Speak Out, Multi–Material Shafts, LINKS—The Best of Golf magazine, Jul./Aug. 2001, p. 90, vol. 14, No. 5, Purcell Enterprises, Inc., Hilton Head Island, SC, USA.

James Achenbach, "Japanese Shafts Gain Popularity", Golf Week Magazine, Aug. 4, 2001, pp. 23 and 25, Turnstile Publishing Company, Orlando, FL, USA.

* cited by examiner

GOLF CLUB SHAFT

This application is a division of U.S. patent application Ser. No. 09/336,790 filed Jun. 21, 1999 (pending), which was a continuation of allowed U.S. patent application Ser. No. 08/730,226 filed Oct. 15, 1996 (now U.S. Pat. No. 5,913,733) which was a continuation-in-part of allowed U.S. patent application Ser. No. 08/567,808 filed Dec. 6, 1995 (now abandoned), which was a continuation of application Ser. No. 08/236,351 filed on Apr. 29, 1994 (now abandoned), which was a continuation-in-part of application Ser. No. 07/999,094 filed Dec. 31, 1992 (now U.S. Pat. No. 5,335,908).

FIELD OF THE INVENTION

This invention relates to golf clubs, more particularly to golf club shafts. More particularly still, this invention relates to an improved aerodynamic golf club shaft.

BACKGROUND OF THE INVENTION

Currently, golf club shafts are hollow steel or graphite tubes that are relatively thick at the grip end of the golf club, and narrow as the clubhead is approached. Typically, current golf club shafts have a series of steps therein. The thickness of the shafts change to a narrower thickness at each step.

Golf club shafts must meet the requirements of the United States Golf Association Rules of Golf to be considered "legal" for tournament play. The USGA Rules require in Appendix II, Rule 4-lb, that the shaft be "so designed and manufactured that at any point along its length:

(i) it bends in such a way that the deflection is the same regardless of how the shaft is rotated about its longitudinal axis; and (ii) it twists the same amount in both directions.

This Rule is believed to be the reason that golf club shafts are currently of circular cross section. Since golf club shafts have previously been believed to require circular cross sections, there has been little opportunity to make golf club shafts more aerodynamic. Another reason golf club shafts are not made more aerodynamic is believed to be an underestimation of the amount of drag created by the shaft when a golf club is swung.

Thus, a need exists for an improved golf club shaft that conforms to the Rules of Golf and is more aerodynamic than current golf club shafts. In particular, a need exists for an improved golf club shaft that allows the golf club to be swung faster by the player with the same or less effort to create more power, and longer shots.

These and other objects of the present invention will be more readily apparent when considered in reference to the following description and when taken in conjunction with the accompanying drawings.

SUMMARY OF THE INVENTION

The present invention relates to an improved aerodynamic golf club shaft. The improved aerodynamic golf club shaft comprises a tube that has an exterior with a non-circular cross section.

The golf club shaft may have an elliptical exterior cross section in one preferred embodiment. The golf club shaft of several embodiments of the present invention is based on the following principle. The shaft has a leading edge that is on the half of the shaft aligned with the face of the golf club and a trailing edge on the half of the shaft aligned with the back of the clubhead. At least a portion of the leading edge of the shaft has a smaller radius of curvature than the leading edge of an equivalently sized conventional shaft having a circular cross section.

A non-limiting number of ways are disclosed of providing a golf club shaft with such a cross section, and still retaining the bending and flexing properties needed to conform to USGA specifications. These include: (1) slipping a hollow sheath having an elliptical exterior cross section onto a standard golf club shaft or other shaft having a circular cross section (i.e., retaining the sheath by friction fit); (2) connecting such a sheath at points spaced equally radially around a circular shaft; (3) adhering a material to the leading edge of a circular shaft; or (4) constructing a hollow shaft having an aerodynamically shaped cross section with walls having different wall thicknesses.

This application also discloses improved mechanisms for connecting golf club shafts to club heads, and in particular to mechanisms that allow shorter hosels to be used, especially on iron golf clubs.

BRIEF DESCRIPTION OF THE DRAWINGS

While the specification concludes with claims particularly pointing out and distinctly claiming the present invention, it is believed the invention will be better understood from the following description taken in conjunction with the accompanying drawings (some of which have been enlarged).

DETAILED DESCRIPTION OF THE INVENTION

Figure 1:
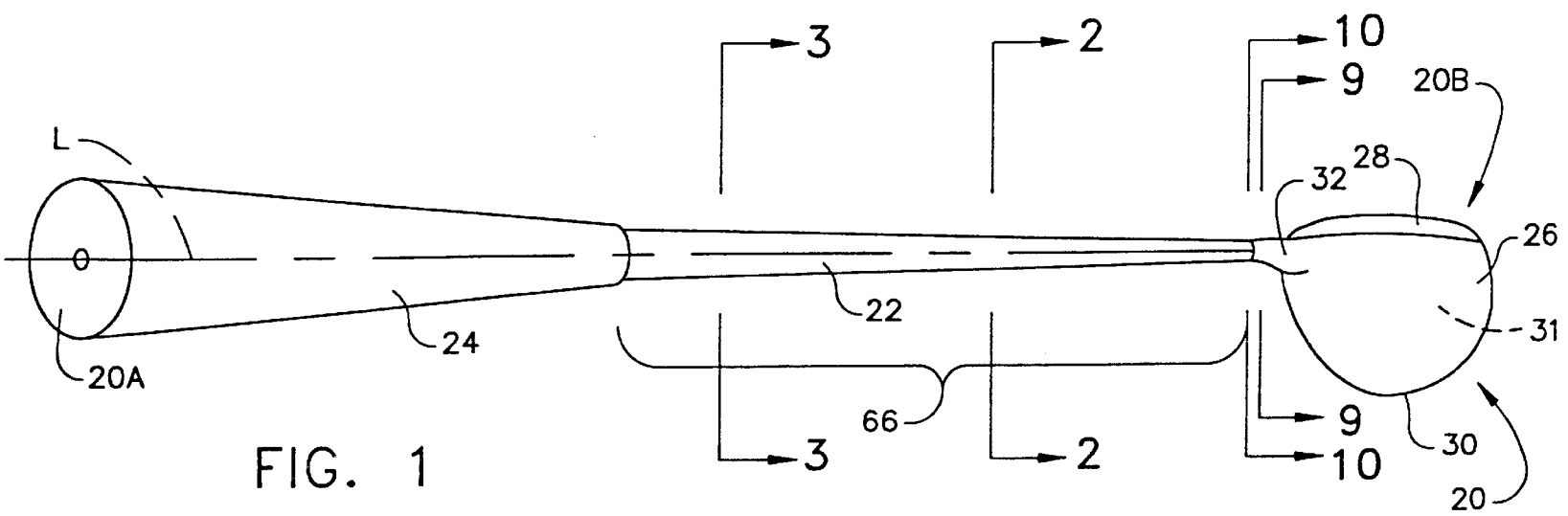
FIG. 1 is a perspective view of the golf club shaft of the present invention.

FIG. 1 is a perspective view of a golf club that is provided with the improved golf club shaft of the present invention.

The golf club 20 has a shaft 22, a grip 24, and a clubhead 26. The shaft runs from the grip end (or "upper end") 20A of the club to the clubhead end (or "lower end") 20B. The clubhead has a clubface 28 for striking the ball, a back 30 on the opposite side of the clubhead, a sole 31, and a hosel 32 where the clubhead end 20B of the shaft 22 is inserted into the clubhead 26.

Figure 2:
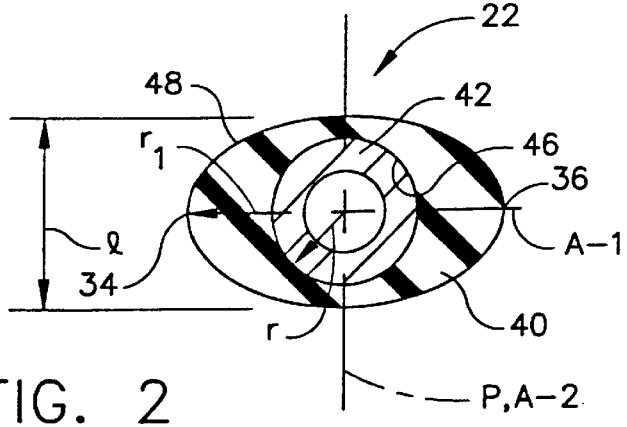
FIG. 2 is a cross sectional view of the golf club shaft of the present invention taken along line 2—2 of FIG. 1.

In the preferred embodiment of the present invention shown in FIG. 2, the golf club shaft 22 has an elliptical cross section. The shaft 22 can be divided in half by a plane, designated P, that runs generally parallel to the portion of the clubface 28 at the sole 31 of the clubhead 26. The golf club shaft 22 has a leading edge 34 that is on the half of the shaft aligned with the face 28 of the golf club. The shaft 22 has a trailing edge 36 on the half of the shaft aligned with the back of the clubhead 30. At least a portion of the leading edge 34 of the shaft has a smaller radius of curvature (designated rl) than the radius (designated r) of the leading edge of a shaft having an equivalently sized (i.e., thickness) circular cross section.

The orientation of the ellipse of the shaft shown in FIG. 2 is defined by a major axis designated A-1, and a minor axis, A-2. The major axis A-1 is the larger axis that runs in the direction of the largest dimension of the ellipse and bisects the ellipse. The minor axis A-2 is perpendicular to the major axis and also bisects the ellipse. FIG. 2 shows that the major axis A-1 can be aligned approximately perpendicular to the clubface 28. This orientation has the advantage that the smaller radius of curvature provided by the leading edge 34 of the shaft reduces the air drag on the shaft as the golf club 20 is swung into the impact area.

Figure 5:
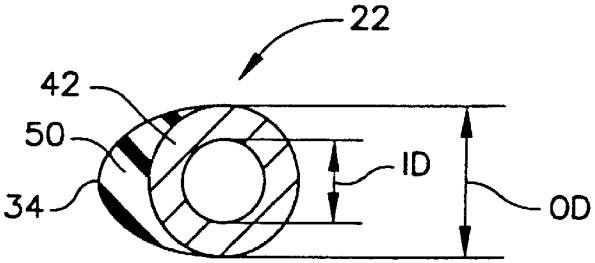
FIGS. 4–7 are cross sectional views of several alternative embodiments of the golf club shaft of the present invention which have non-circular cross sections.
Figure 7:
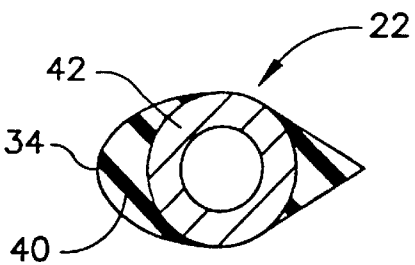

In alternative embodiments, the shaft 22 may be of some other cross sectional shape. For example, as shown in FIG. 5, the exterior cross section of the improved golf club shaft of the present invention need not be elliptical. Other suitable aerodynamic shapes (such as the tear-shaped cross section of the shaft shown in FIG. 7) can also be used. The key to these embodiments is that at least a portion of the leading edge 34 of the shaft 22 has a smaller radius of curvature than the leading edge of a shaft having an equivalently sized circular cross section. This provides the shaft with an aerodynamic leading edge 34.

The phrase "equivalently sized circular cross section", as used herein, refers to shafts having a circular cross section with an outside diameter (shown as "OD" in FIG. 5) equal to the smallest outside dimension of the shaft of the present invention. For example, an equivalently sized shaft to the shaft of the present invention shown in FIG. 2 is a circular shaft that has a diameter equal to the length, 1, of the minor axis of the ellipse. The shaft of the present invention may also have a leading edge with a smaller radius of curvature than circular shafts with a smaller diameter than the smallest outside dimension of the shaft of the present invention. In particular, the leading edge 34 should have a smaller radius of curvature than conventional golf club shafts having circular cross sections of such as any of those manufactured by Aldila, Inc., or manufactured under the tradename of True Temper by True Temper Sports of Memphis, Tenn. (the specifications of which are incorporated by reference herein). (That is, the leading edge 34 should have a radius of curvature of less than about 0.47 cm at the tip and less than about 0.8 cm at the butt.) In addition, although the leading edge 34 is described as having a "radius of curvature", the shaft of the present invention is not limited to shapes having cross sections defined strictly by curvilinear segments. It is within the scope of the present invention for the cross section of the leading edge 34 to be formed by rectilinear segments, curvilinear segments, or both.

The cross sectional shape of the shaft 22 can be constant down the length of the shaft, or it can vary down the length of the shaft. The cross section can vary in the alignment of the axes of the ellipses and/or the size of the ellipses. The cross sectional shape of the shaft could, for example, be used to reduce drag on the shaft when it is in different positions during the golfer's swing, to bring the golfer's swing into impact on a certain swing path, or both. For instance, the shaft 22 can have the cross section shown in FIG. 3 near the grip 24. The cross section of the portion of the shaft near the grip is oriented to reduce wind resistance when the golfer is pulling the club into the ball on the way down from the top of the swing. The portion of the shaft having the cross section shown in FIG. 2 could then serve to assist the golfer in moving the club into the impact zone by minimizing drag and squaring the clubface.

The shaft 22 is preferably constructed so that any variations in the cross section of the shaft 22 are gradual so that there is a smooth transition along the shaft between such different cross sections. In addition, the shaft 22 of the present invention can be provided with a series of "step downs" similar to current golf club shafts.

Figure 3:
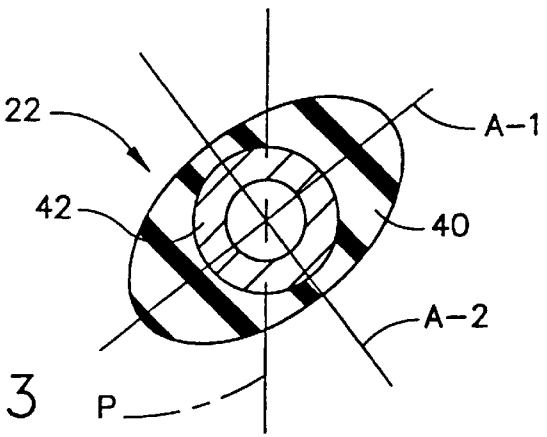
FIG. 3 is a cross sectional view of the golf club shaft of the present invention taken along line 3—3 of FIG. 1.

The aerodynamic golf club shaft 22 of the present invention can be created in a number of different ways. FIGS. 2 and 3 show embodiments in which the shaft 22 is created by slipping a hollow tube or sheath 40 onto a standard golf club shaft (or circular shaft having a smaller than standard diameter) 42. The sheath 40 has interior walls 46 and exterior walls 48 that define a circular interior cross section and an elliptical exterior cross section.

The sheath 40 can be held in place by fitting snuggly over the circular shaft 42 (i.e., friction fit), or it can be affixed to the circular shaft. The sheath 40 can be affixed to the circular shaft 42 with an adhesive similar to that used to affix the grip 24 to the shaft 22, or by the method used to affix the plastic tube to the aluminum tube in U.S. Pat. No. 5,094,454 issued to Schering.

The sheath 44 is preferably compressible (and/or deformable) to permit flexing of the shaft 22 and to provide the same flexibility in all directions. The sheath 40 is preferably also resilient so that it returns to its original shape after it is compressed through bending or twisting. A suitable type of material useful as the sheath 40 is a compressible rubber material.

Preferably, the sheath 40 also comprises (or is coated with) a material that has a low coeffecient of drag so that it will have a reduced tendency to be affected by air drag or wind resistance when the club is swung. A suitable material that has a low coefficient of drag that might be useful for the sheath is the material (or some suitable variation of the same) used in the swimsuits of the U.S. Olympic athletes in the 1992 Olympics which has a reduced drag in water.

Other suitable materials include, but are not limited to polyolefins, and plastics such as the material used in the golf clubs described in U.S. Pat. No. 5,094,454 issued to Schering, U.S. Pat. No. 4,936,582 issued to Bernstein, and U.S. Pat. No. 4,326,716 issued to La Coste. (Of course, in the present invention, the entire shaft must be capable of performing similarly to or better than current shafts in bending and twisting when the golf club 20 is used to strike a golf ball, and should not deform like the novelty shafts described in some of the above patents.)

Figure 4:
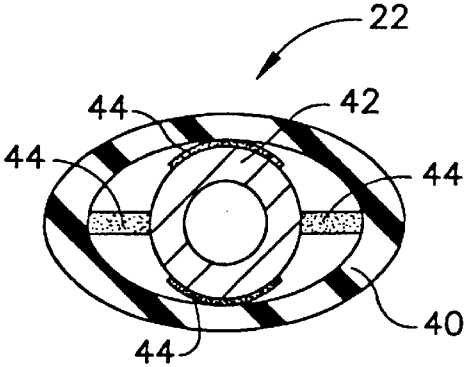

FIG. 4 shows an alternative embodiment in which the shaft 22 of the present invention is created by connecting a sheath 40 such as the one described above to a shaft 42 having a circular cross section by fasteners 44 that are located at points spaced equally radially around the shaft having the circular cross section. The fasteners 44 can be adhesive fasteners in the form of spots, lines, etc. The fastening of the sheath 40 to the shaft 42 in this embodiment provides the advantage that it allows the circular shaft 42 to serve as the load bearing structural member of the composite shaft. The circular shaft 42 bends and twists like a conventional golf club shaft. The sheath 40 does not interfere with the functioning of the circular shaft 42 due to the equal spacing of the fasteners which bond the two components. In other embodiments, the sheath (or other material affixed to the circular shaft) 40 can be used to reinforce the circular shaft 42 so that a circular shaft of lesser cross section can be used.

FIG. 5 shows an embodiment in which the shaft 22 of the present invention is created by adhering a material 50 to the leading edge 34 of a shaft 42. The material can be any of the materials specified above as being suitable for use as the sheath. This embodiment has the advantage of providing an areodynamic leading edge with lesser material (and, thus, lesser weight) than embodiments that use sheaths to completely surround a shaft.

The shafts 42 having the circular cross sections that are used in the alternative embodiments described above can be a standard shaft, or it could be a smaller diameter shaft of some suitable type. The shaft 42 with the circular cross section can be made of any of the materials currently used in the construction of golf club shafts. These materials include, but are not limited to: steel, aluminum, graphite, boron, carbon, or combinations of these and other suitable materials.

Figure 6:
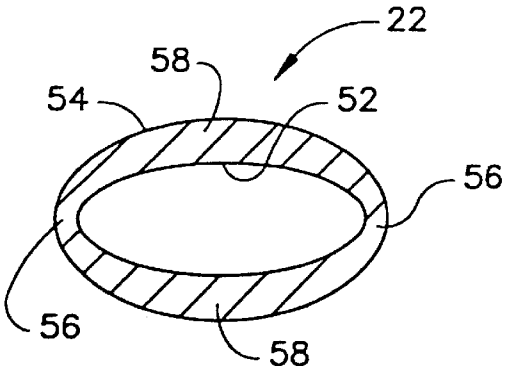

FIG. 6 shows an embodiment in which the shaft 22 of the present invention is created by constructing an elliptical (or other suitable cross sectional shape) shaft with interior walls 52 and exterior walls 54 having different wall thicknesses between its interior and exterior walls. The wall thicknesses are provided such that the portions of the shaft having the largest cross sectional dimension (the first portions 56 of the shaft) have thinner walls than those second portions 58 of the shaft with smaller cross sectional dimensions. The wall thicknesses are used to equalize the bending and twisting properties of the shaft in both directions.

The above methods of making the cross section of the shaft 22 elliptical (or otherwise non-circular) are believed to keep the flexibility and twisting properties of the shaft 22 the same in all directions.

Figure 8A:
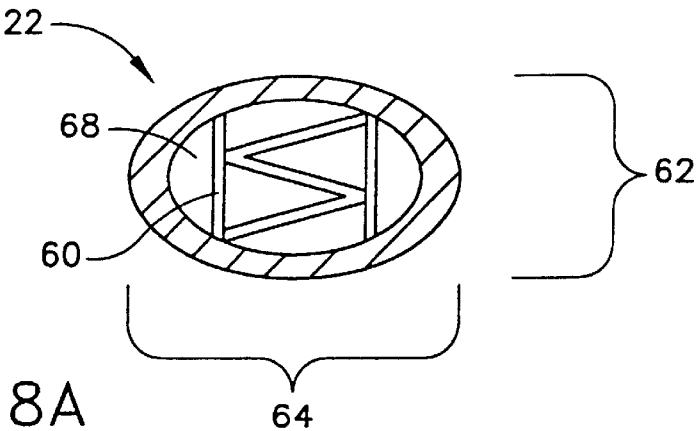
FIGS. 8 and 8A are cross sectional views of alternative embodiments of the present invention that have an internal truss-like structures.
Figure 8:
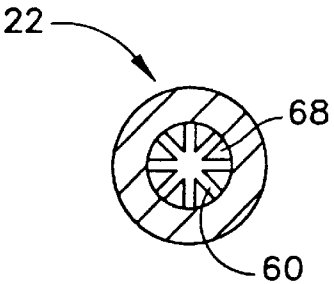

FIGS. 8 and 8A are cross sectional views of alternative embodiments of the present invention that have a hollow cross section that provides a tunnel 68 and an internal truss-like reinforcing structures 60 in the tunnel 68. The internal truss-like structure 60 preferably extends from one side of the interior wall of the shaft to the opposite side. The internal truss-like structure 60 of the shaft shown in FIG. 8 may be used to provide the shaft with enough strength so that the shaft can be made with a smaller exterior cross section (and, thus, more areodynamic). This truss-like structure 60 can also be used to make a lightweight shaft having sufficient strength with thinner walls than conventional shafts.

The internal truss-like structure 60 of the shaft shown in FIG. 8A is used for a different purpose. This internal truss-like structure 60 (or some variation of the same) is used to equalize the bending and flexing properties of the shaft in both directions as an alternative to varying the wall thickness of a non-circular shaft. The truss 60, in essence, reinforces the narrower portions of the shaft (the portions of the shaft having the smallest exterior dimension) 62, and provides the narrower portions 62 of the shaft with the same twisting and bending properties as the wider portions 64 of the shaft.

Figure 10:
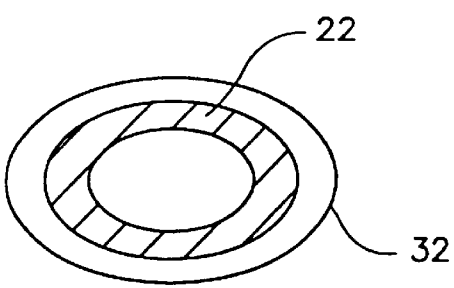
FIG. 10 is a cross section taken along line 10—10 of FIG. 1 of a golf club having a shaft and hosel both of which have elliptical cross sections.
Figure 9:
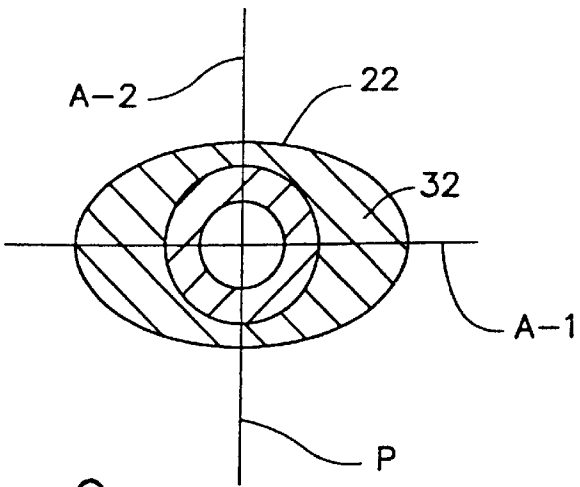
FIG. 9 is a cross section taken along line 9—9 of FIG. 1 of a golf club having a shaft with a circular cross section and a hosel with an elliptical cross section.

FIGS. 9 and 10 are cross sections of a hosel 32 and shaft 22 of an alternative construction in which the hosel, the shaft, or both, have an areodynamic cross section. The cross sectional shape of these components can be any of the cross sections described above as being suitable for the shaft.

FIG. 9 shows a shaft 22 having a circular cross section that is inserted into a club having a hosel 32 with an improved, areodynamic elliptical cross section. The circular cross section of the shaft allows the shaft to have the same bending and twisting properties in each direction while the shape of the hosel 32 is able to create a reduction in the overall air drag on the golf club. In addition, the hosel 32 can be made thinner and lighter because it is believed that the majority of the stresses exerted on the hosel 32 when the club is used to strike a golf ball is in the direction of the major axis of the elliptical hosel. The larger major axis of the hosel 32 is reinforces the hosel against these stresses.

FIG. 10 is a cross section of a shaft 22 and hosel 32, both of which have elliptical cross sections. The embodiment shown in FIG. 10 is used with shafts having the improved areodynamic shape of the embodiments described above. The elliptical cross section of the shaft reinforces the lower portions of the shaft against stresses and allows the shaft and hosel to be made thinner and elliptical to reduce drag.

In an alternative embodiment, the shaft can have a circular cross section where it enters the hosel and an elliptical cross section at all points below. The portion of the shaft having a circular cross section is the uppermost portion of the shaft that is affixed to the hosel. Therefore, this is the portion of the shaft that the rest of the shaft twists and bends around. The portion of the shaft provided with a circular cross section is, therefore, used to equalize the bending and twisting properties of the shaft.

A further consideration in the design of the golf club shaft of the present invention is the cross section of the portion of the shaft that is inserted into the grip 24 of the golf club 20. The cross section of the grip 24 must be circular to conform to USGA specifications. To meet this requirement, the portion of the shaft 22 that is inserted into the grip 24 could be circular (while the exposed portion 66 of the shaft is elliptical, etc.). Alternatively, the shaft 22 can have an elliptical cross section at the grip end 20B, and the grip 24 could have an elliptical interior cross section and a circular exterior cross section so that it will fit closely over the shaft and provide a grip 24 with a circular cross section.

FIGS. 11–14 show several variations of improved mechanisms (or "connections") for connecting golf club shafts to club heads. The connections shown in FIGS. 11–14 can be used with any of the embodiments of the improved golf club shaft described herein, or they can be used with any shafts having conventional circular cross-sections. For simplicity of illustration, the connections are shown on shafts having circular cross-sections.

Figure 11:
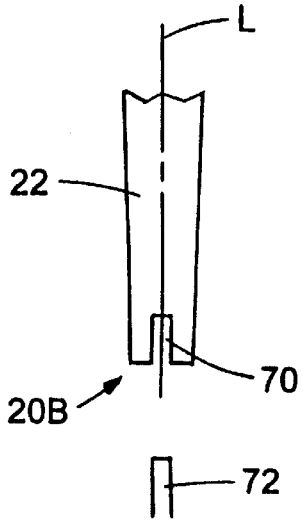
FIG. 11 is a fragmentary schematic view of a portion of the tip of a golf club shaft that has a slot therein and an element on a hosel that is capable of mating with the shaft.

FIG. 11 is a fragmentary schematic view of a portion of the lower end or "tip" 20B of a golf club shaft 22 that has a slot 70 therein and a mating hosel element 72. The slot 70 is preferably oriented generally parallel to the longitudinal axis of the shaft. In other embodiments, the slot could be oriented at an angle relative to the longitudinal axis of the shaft. The hosel element 72 is capable of mating with the slot 70 on the tip 20B of the shaft 22. In a preferred embodiment, the hosel element 72 is formed on the inside of the hosel (that is, on the interior wall of the hosel). In other embodiments, the hosel element 72 can be formed on the outside of the hosel, and the shaft to hosel connection can be in the form of a shaft over hosel connection.

Figure 12:
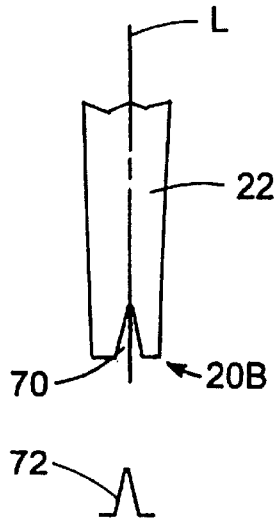
FIG. 12 is a fragmentary schematic view similar to FIG. 11, showing a portion of the tip of a golf club shaft and mating hosel element which have an alternative configuration.

FIG. 12 is a fragmentary schematic view similar to FIG. 11, showing a portion of the tip 20B of a golf club shaft 22 having a slot 70 with an alternative configuration and its a mating hosel element 72. In FIG. 12, the tip 20B of the shaft 22 has a slot 70 with a wedge-shaped configuration.

The slots in the tip 20B of the shaft can be formed by simply cutting a slot of the desired configuration into the tip 20B of the shaft. The mating hosel element 72 can be made by casting the club head with a hosel element of the desired shape. The shaft and hosel may be attached in any manner known in the art, including, but not limited to friction fit, adhesives, providing a separate element that secures the shaft and the hosel together, welding, etc. Variations of the embodiments shown in FIGS. 11 and 12 can be provided with slots and mating hosel elements having any other suitable interlocking shapes. In addition, although often only one slot and mating hosel element is shown in each of these figures, in these or any of the other embodiments described below, there can be one or more of any of the various elements shown and described.

Figure 13:
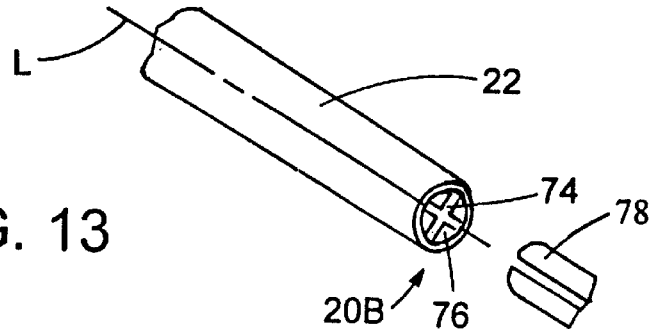
FIG. 13 is a fragmentary perspective view showing a portion of the tip of a golf club shaft having a mechanism for connecting to a hosel that is located inside the shaft, and a mating hosel element.

FIG. 13 is a fragmentary perspective view showing a portion of the tip of a golf club shaft having another type of mechanism for connecting the shaft 22 to a hosel, and its mating hosel element. The mechanism shown in FIG. 13 comprises an element that is located at least partially inside the tip 20B of the shaft 22. In the embodiment shown in FIG. 13, the element 74 located inside the shaft 22 has an "X" -shaped cross-section with four openings 76 therein. The hosel is provided with an annular ring for receiving the tubular portion of the tip 20B of the shaft, and four projections 78 for fitting in the openings 76 in the interior element 74.

In other variations of the embodiment shown in FIG. 13, the element 74 may be provided in many other cross-sections, with any different number of openings. In still other versions of such an embodiment, the element 74 on the inside of the shaft 22 may be provided with one or more projections. These projections could extend beyond the tip 20B of the shaft (so that the element 74 comprises portions that are also at least partially outside the end of the shaft). Such projections provided on the element 74 that is located partially inside the shaft 22 can fit into mating openings in the interior of the hosel.

Figure 14:
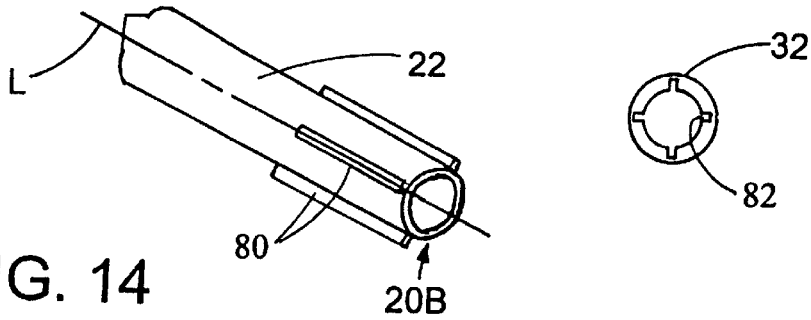
FIG. 14 is a fragmentary perspective view showing a portion of the tip of a golf club shaft having a mechanism for connecting to a hosel that is located on the outside of the shaft.

FIG. 14 is a fragmentary perspective view showing a portion of the tip 20B of a golf club shaft having another type of mechanism for connecting a shaft 22 to a hosel. In the embodiment shown in FIG. 14, the mechanism comprises at least one element, and preferably a plurality of elements, 80 that are located on the outside of the shaft 22. The elements 80 preferably oriented generally parallel to the longitudinal axis of the shaft 22. In this case, the hosel 32 has at least one opening, and preferably a plurality of openings 82 therein for receiving the element(s) 80 located on the outside of the shaft 22.

The connections shown in the preceding drawing figures increase the strength of the connection between the shaft and hosel so that shorter hosels may be used, particularly on iron golf clubs. This provides the advantage that weight can be removed from the hosel and distributed to the club head, for more effective weight distribution. The shaft to hosel connections described herein can also be used to precisely align any seam in the shaft with the club head, or to properly align the leading edge of the non-circular shafts described herein. Any suitable club head can be used with the shaft of the present invention. Some examples of suitable club heads are described in U.S. Pat. No. 5,540,437 issued to Bamber on Jul. 30, 1996.

The disclosures of all patents and publications mentioned throughout this patent application are hereby incorporated by reference herein. It is expressly not admitted, however, that any of the documents incorporated by reference herein teach or disclose the present invention. It is also expressly not admitted that any of the commercially available materials or products described herein teach or disclose the present invention.

While particular embodiments of the present invention have been illustrated and described, it would be obvious to those skilled in the art that various other changes and modifications can be made without departing from the spirit and scope of the invention.

What is claimed is:

1. A golf club shaft having a longitudinal axis, a cross-section, and a length, wherein the cross-section of said shaft is provided with a means for equalizing its bending and twisting properties so that said shaft bends in such a way that the deflection of said shaft is the same regardless of how the shaft is rotated about its longitudinal axis, and said shaft twists with respect to its longitudinal axis the same amount in both the clockwise and counterclockwise directions.

2. The golf club shaft of claim 1 wherein the portion of said shaft having a non-circular cross-section has an elliptical cross-section.

3. The golf club shaft of claim 1 wherein the portion of said shaft having a non-circular cross-section has a tear drop-shaped cross-section.

4. The golf club shaft of claim 1 having a leading portion and a trailing portion when joined to a golf club head wherein a portion of said shaft having a non-circular cross-section has material added to its leading edge which provides said portion of said shaft with non-circular cross-section.

5. The golf club shaft of claim 1 wherein a portion of said shaft is configured for receiving grip for a golf, and said portion of said shaft configured for receiving a grip has cross-section which is circular.

6. The golf club shaft of claim 1 wherein more than one portion of said shaft has non-circular cross-section.

7. The golf club shaft of claim 6 wherein said portions of said shaft having a non-circular cross-section have elliptical cross-sections, and each elliptical cross-section has a major axis and a minor axis, and said portions have cross-sections that vary in the alignment if the axes of the ellipses.

8. A golf club comprising the golf club shaft of claim 1.

* * * * *

UNITED STATES PATENT AND TRADEMARK OFFICE

CERTIFICATE OF CORRECTION

PATENT NO. : 6,561,922 B2
DATED : May 13, 2003
INVENTOR(S) : Jeffrey V. Bamber

It is certified that error appears in the above-identified patent and that said Letters Patent is hereby corrected as shown below:

Column 8,
Line 29, after "said shaft", insert:
-- along at least a portion of the length of said shaft is non-circular, and said shaft --.

Signed and Sealed this

Sixteenth Day of March, 2004

JON W. DUDAS
*Acting Director of the United States Patent and Trademark Office*